United States Patent [19]

Leone

[11] Patent Number: 4,581,511

[45] Date of Patent: Apr. 8, 1986

[54] MOLDED CASE CIRCUIT BREAKER WITH AN IMPROVED INTERNAL VENTING SYSTEM

[75] Inventor: David A. Leone, Aliquippa, Pa.

[73] Assignee: Westinghouse Electric Corp., Pittsburgh, Pa.

[21] Appl. No.: 655,957

[22] Filed: Sep. 28, 1984

[51] Int. Cl.[4] ..... H01H 9/34

[52] U.S. Cl. ..... 200/306; 200/144 R

[58] Field of Search ..... 200/306, 144 R; 335/201

[56] References Cited

U.S. PATENT DOCUMENTS

| | | | |
|---|---|---|---|
| 2,863,969 | 12/1958 | Edmunds | 200/306 |
| 3,341,791 | 9/1967 | Leonard | 200/306 |
| 3,649,791 | 3/1972 | Kruckewitt | 200/144 R |
| 4,271,339 | 6/1981 | Meister et al. | 200/144 R |

*Primary Examiner*—Stephen Marcus
*Assistant Examiner*—R. S. Kidorf
*Attorney, Agent, or Firm*—M. S. Yatsko

[57] ABSTRACT

A molded case circuit breaker includes an improved system for internally venting gaseous arc products to control the internal gas pressure increase and expansion during an arc interruption. The system includes a first gas expansion chamber disposed proximate to a stationary electrical contact of a pair of separable electrical contacts of the circuit breaker and a second gas expansion chamber disposed proximate to an electrically insulating arc chute barrier that is positioned at an end of an elongated arc chute remote from said stationary electrical contact. The arc chute barrier and the stationary electrical contact are physically configured to effect the rapid internal venting of gaseous arc products to the first and second chambers.

12 Claims, 6 Drawing Figures

MOLDED CASE CIRCUIT BREAKER WITH AN IMPROVED INTERNAL VENTING SYSTEM

CROSS REFERENCE TO RELATED APPLICATIONS

The invention disclosed herein relates to molded case circuit breakers. The inventions disclosed in the following four commonly assigned U.S. patent applications also relate to molded case circuit breakers: U.S. patent applications Ser. Nos. 440,680, now abandoned; 440,681 U.S. Pat. No. 4,503,408; 440,682; and 440,683, now abandoned, all of which were filed on Nov. 10, 1982. In addition, commonly assigned U.S. Pat. No. 4,489,295 also relates to molded case circuit breakers.

The following six commonly assigned U.S. patent applications were all filed in the U.S. Patent and Trademark Office on Dec. 19, 1983 and relate to molded case circuit breakers: Ser. No. 562,647; Ser. No. 562,648; Ser. No. 562,643 now U.S. Pat. No. 4,528,531; Ser. No. 562,644; Ser. No. 562,602; and Ser. No. 562,603.

The following six commonly assigned U.S. patent applications were filed in the U.S. Patent and Trademark Office on Jan. 9, 1984 and relate to molded case circuit breakers: Ser. No. 569,059 now abandoned; Ser. No. 569,058; Ser. No. 569,057; Ser. No. 569,056; Ser. No. 569,055; and Ser. No. 569,054.

Finally, the following four commonly assigned U.S. patent applications were filed in the U.S Patent and Trademark Office on Sept. 28, 1984, the same day as this patent application and relate to molded circuit breakers: Ser. No. 06/655,952, filed by Alfred E. Maier and James R. Farley and entitled Molded Case Circuit Breaker With Calibration Adjusting Means For A Bimetal; Ser. No. 06/655,956 filed by David A. Leone and entitled Molded Case Circuit Breaker With An Improved Arc Gas External Venting System; Ser. No. 06/655,955 filed by David A. Leone and entitled Molded Case Circuit Breaker With A Movable Arm Shock Absorbing Member; Ser. No. 655,954 filed by David A. Leone and Douglas C. Marks and entitled Molded Case Cirucit Breaker With A Trip Mechanism Having An Intermediate Latch Lever.

BACKGROUND OF THE INVENTION

A. Field of the Invention

The device of the present invention generally relates to a molded case circuit breaker and, more particularly, to an improved internal venting system for a molded case circuit breaker.

B. Description of the Prior Art

Circuit breakers and, more particularly molded case circuit breakers are old and well known in the prior art. Examples of such devices are disclosed in U.S. Pat. Nos. 2,186,251; 2,492,009; 3,239,638; 3,525,959; 3,590,325; 3,614,685; 3,775,713; 3,783,423; 3,805,199; 3,815,059; 3,863,042; 3,959,695; 4,077,025; 4,166,205; 4,258,403; and 4,295,025. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized an operating mechanism having a trip mechanism for controlling the movement of an overcenter toggle mechanism to separate a pair of electrical contacts upon an overload condition or upon a short circuit or fault current condition. Such trip mechanisms have included a bimetal movable in response to an overload condition to rotate a trip bar to open a pair of electrical circuit breaker contacts. Such prior art devices have also utilized an armature movable in response to the flow of short circuit or fault current similarly to rotate the trip bar to cause the pair of contacts to separate. A significant problem in providing high interrupting capacities in a dimensionally small circuit breaker is controlling the internal gas pressure increase and expansion which occurs during arc interruption. Structural damage to the molded case breaker can result from such gas pressure increase. The arc gases can be allowed to expand internally in order to control the pressure increase, however, this internal expansion is limited by the physical volume available, the physical configurations and dispositions of the internal components of the circuit breaker and the desired interrupting performance characteristics.

While many prior art devices have provided adequate protection against fault conditions in an electrical circuit, a need exists for dimensionally small molded case circuit breakers capable of fast, effective and reliable operation and, more specifically, for components thereof that are designed for controlling the internal gas pressure increase and expansion during an arc interruption.

SUMMARY OF THE INVENTION

An object of the present invention is to provide a new and improved circuit breaker.

Another object of the present invention is to provide a new and improved molded case circuit breaker having means for internally venting gaseous arc products to control the internal gas pressure increase and expansion during an arc interruption.

Briefly, the present invention relates to a molded case circuit breaker having an improved system for internally venting gaseous arc products to control the internal gas pressure increase and expansion during an arc interruption. The system includes a first gas expansion chamber disposed proximate to a stationary electrical contact of a pair of separable electrical contacts of the circuit breaker and a second gas expansion chamber disposed proximate to an electrically insulating arc chute barrier positioned at an end of an elongated arc chute remote from said stationary electrical contact. The arc chute barrier and the stationary electrical contact are physically configurated to effect the rapid internal venting of gaseous arc products to the first and second chambers.

BRIEF DESCRIPTION OF THE DRAWING

The above and other objects and advantages and novel features of the present invention will become apparent from the following detailed description of the preferred an alternative embodiments of a molded case circuit breaker illustrated in the accompanying drawing wherein.

DESCRIPTION OF THE PREFERRED EMBODIMENT

Figure 1:
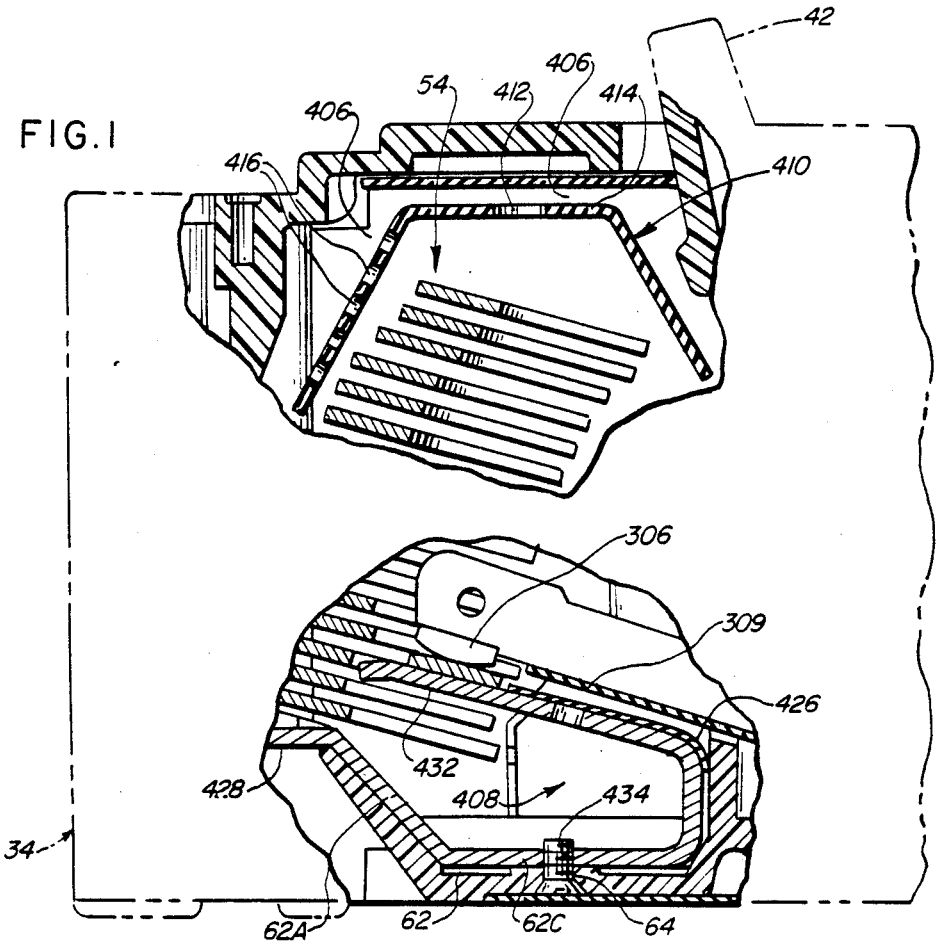
FIG. 1 is an enlarged, partially broken-away, cross sectional view of an internal venting system for use in a molded case circuit breaker.
Figure 2:
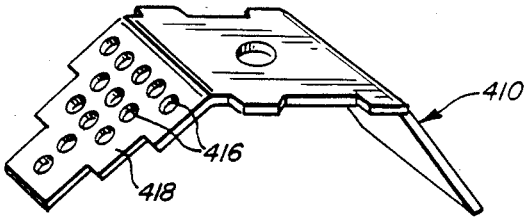
FIG. 2 is a perspective view of an electrically insulating arc chute barrier of the system of FIG. 1.
Figure 3:
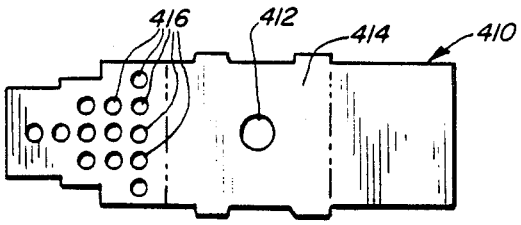
FIG. 3 is a top plan view of the barrier of FIG. 2.

The improved internal venting system constructed in accordance with the principles of the present invention is described hereinafter with respect to FIGS. 1–6. A circuit breaker in which the improved internal venting system can be utilized is described in more complete detail from column 4, line 25 through column 14, line 41 of U.S. Pat. No. 4,528,531, issued July 9, 1985. The indicated material from this patent is hereinto incorporated by reference.

In accordance with FIGS. 1–4, an improved internal venting system for venting internally gaseous arc products includes an upper gas expansion chamber 406 and a lower gas expansion chamber 408. The upper chamber 406 is located above an electrically insulating arc chute insulation barrier 410 disposed above the arc chute 54 and at an end thereof remote from a lower or stationary electrical contact 424. The barrier 410 includes an aperture 412 formed through an upper surface 414 thereof. The size of the aperture 412 controls the rate of gas expansion into the upper chamber 406. One or a plurality of holes 416 may be provided as desired in an inclined side 418 of the barrier 410 to assist in venting arc gases to the upper chamber 406.

Figure 4:
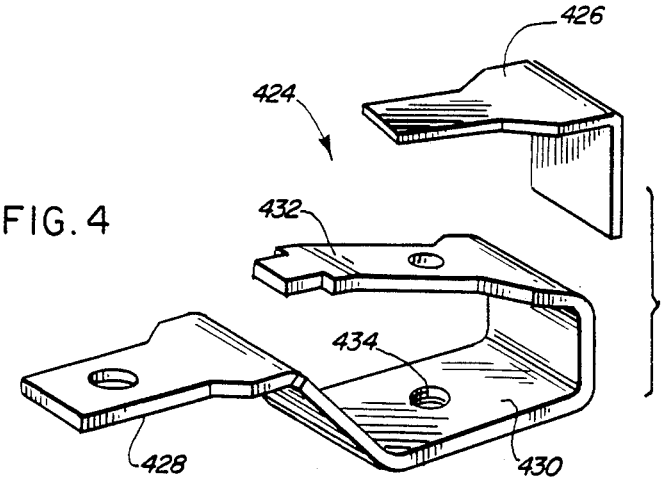
FIG. 4 is an exploded perspective view of a stationary electrical contact and of an associated electrically insulating barrier of the system of FIG. 1.
Figure 5:
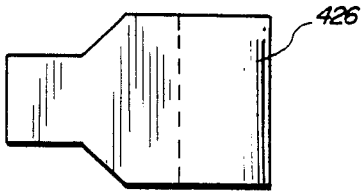
FIG. 5 is a top plan view of the electrically insulating barrier of FIG. 4.
Figure 6:
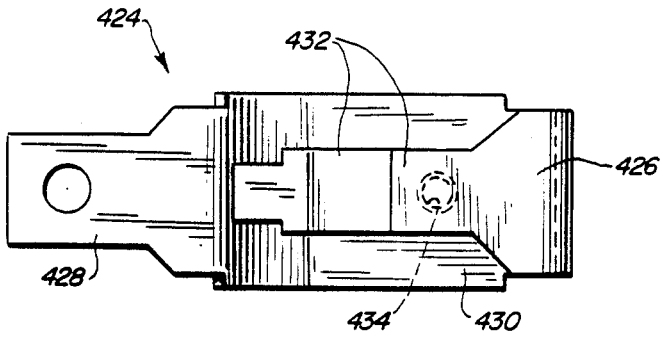
FIG. 6 is an enlarged, fragmentary, top plan view of the contact and barrier of FIG. 4.

Referring to FIGS. 4–6, the lower or stationary electrical contact 424 and an associated electrically insulating barrier 426 are physically configured to assist in the rapid venting of arc gases to the lower gas expansion chamber 408. The contact 424 is formed as a one piece member having a terminal end portion 428, a base portion 430 and an upstanding contact mounting portion 432 that is dimensionally reduced in its lateral extension (FIG. 6) as compared to the lateral extension of the base portion 430. An opening or hole 434 is provided in the base portion 430 to receive a mounting screw. The contact 424 and the barrier 426 are tapered to reduce their lateral extension in order to effect rapid arc gas internal venting and expansion to the lower chamber 408.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. An electrical circuit breaker comprising a first movable electrical contact, a second stationary electrical contact including an integrally formed terminal end portion, an integrally formed base portion and an integrally formed upstanding contact mounting portion, said first and second electrical contacts being movable into a CLOSED position and into an OPEN position, an elongated arc chute within which said first contact is movable;

a case for housing the internal components of said circuit breaker, and means for internally venting gaseous arc products to control the internal gas pressure increase and expansion during an arc interruption comprising first and second gas expansion chambers and an electrically insulating arc chute barrier, said first gas expansion chamber being disposed proximate to said second electrical contact and said second gas expansion chamber being disposed proximate to said arc chute barrier, said arc chute barrier being positioned at an end of said arc chute remote from said second electrical contact, said upstanding contact mounting portion being dimensionally smaller with respect to its lateral extension than the lateral extension of said base portion to effect the rapid venting of said gaseous arc products to said first gas expansion chamber.

2. An electrical circuit breaker as recited in claim 1 wherein said arc chute barrier has at least one aperture formed therein for venting said gaseous arc products to said second gas expansion chamber.

3. An electrical circuit breaker as recited in claim 2 wherein the size of said aperture is variably predetermined in order to control the rate of the internal venting of said gaseous arc products to said second gas expansion chamber.

4. An electrical circuit breaker comprising a movable electrical contact, a stationary electrical contact, said movable and stationary electrical contacts being movable into a CLOSED position and into an OPEN position, a case for housing the internal components of said circuit breaker, and means for internally venting gaseous arc products to control the internal gas pressure increase and expansion during an arc interruption, said venting means comprising a gas expansion chamber disposed proximate to said stationary electrical contact, said stationary contact comprising an integrally formed terminal end portion, an integrally formed base poriton and an integrally formed upstanding contact mounting portion, the lateral extension of said upstanding contact mounting portion being dimensionally less by a predetermined amount than the lateral extension of said base portion thereby to effect the rapid venting of said gaseous arc products to said gas expansion chamber.

5. An electrical circuit breaker as recited in claim 4 further comprising an electrically insulating stationary contact barrier configured to conform physically to at least a portion of said upstanding contact mounting portion that is dimensionally less in its lateral extension than said lateral extension of said base portion thereby to effect the rapid venting of said gaseous arc products to said gas expansion chamber.

6. An electric circuit breaker comprising a stationary contact structure comprising a contact-bearing member with a contact disposed thereon, a movable contact member movable into and from cotact engagement with said contact, an arc chute for extinguishing electric arcs drawn between said contact and the movable contact member upon movement of the latter from said contact engagement, said stationary contact structure being disposed at one end of the arc chute, a gas expansion chamber formed at said one end of the arc chute and having said stationary contact structure associated therewith, said gas expansion chamber being open toward the arc chute and having a configuration enabling arc gas, upon the initiation of an arc, to expand directly into the gas expansion chamber, and casuing air forced from the expansion chamber by the expanding arc gs to be directed into the arc chute.

7. An electric circuit breaker according to claim 6 wherein said stationary contact structure has associated therewith an insulating barrier which is interposed between the movable contact member and said contact-bearing member and extends in overlying relationship with respect to the latter from adjacent said contact thereon, said insulating barrier having, adjacent said contact, a portion which substantially corresponds in width to the underlying portion of the contact-bearing member.

8. An electric circuit breaker according to claim 6 including an additional gas expansion chamber formed adjacent the opposite end of the arc chute.

9. An electric circuit breaker according to claim 8, wherein said arc chute has a baffle disposed across said opposite end thereof, said baffle having formed therein at last one aperture of predetermined size providing gas flow communication between the arc chute and said additional gas expansion chamber.

10. An electric circuit breaker according to claim 6 wherein said stationary contact structure is disposed in said gas expansion chamber and generally U-shaped, with one leg thereof extending along the bottom of the gas expansion chamber and with the other leg thereof connected to said one leg through a bight and extending from the bight toward the arc chute, said other leg constituting said contact-bearing member and having said contact disposed on a portion thereof located at the mouth of said arc expansion chamber, said portion being smaller in width than the mouth of the arc expansion chamer.

11. An electric circuit breaker according to claim 10, wherein said one leg of the generally U-shaped contact structure includes an inclined portion disposed opposite and inclined toward the contact-bearing portion of the other leg.

12. An electric circuit breaker according to claim 11, wherein said stationary contact structure includes a terminal portion extending from said inclined portion.

* * * * *